US007744268B2

(12) United States Patent
White et al.

(10) Patent No.: US 7,744,268 B2
(45) Date of Patent: Jun. 29, 2010

(54) METHOD OF MIXING BY GAS INJECTION

(76) Inventors: Christopher White, 21341 Stone Bridge Ct., Denham Springs, LA (US) 70726; Bryan Kapp, P.O. Box 141, Avery Island, LA (US) 70513

( * ) Notice: Subject to any disclaimer, the term of this patent is extended or adjusted under 35 U.S.C. 154(b) by 1121 days.

(21) Appl. No.: 11/326,738

(22) Filed: Jan. 6, 2006

(65) Prior Publication Data

US 2006/0114744 A1 Jun. 1, 2006

Related U.S. Application Data

(63) Continuation of application No. PCT/US2005/021567, filed on Jun. 17, 2005.

(60) Provisional application No. 60/616,691, filed on Oct. 7, 2004.

(51) Int. Cl.
*B01F 5/04* (2006.01)

(52) U.S. Cl. ..... 366/106; 366/107

(58) Field of Classification Search ..... 366/101, 366/106, 107; 435/296.1
See application file for complete search history.

(56) References Cited

U.S. PATENT DOCUMENTS 981,098 A * 1/1911 McCaskell ..... 422/224
1,872,548 A * 8/1932 Lowen ..... 8/147
2,916,058 A 12/1959 Unthank
3,030,081 A 5/1962 Wilson et al.
3,132,846 A 5/1964 Siddall
4,595,296 A 6/1986 Parks
5,632,554 A 5/1997 Wang et al.
5,897,012 A 4/1999 Sortwell
6,071,005 A 6/2000 Ekambaram et al.
7,384,027 B2 * 6/2008 Terentiev et al. ..... 261/93
2003/0043688 A1 3/2003 Peterson et al.
2003/0076737 A1 4/2003 Grassi
2003/0205581 A1 11/2003 Wertenberger

FOREIGN PATENT DOCUMENTS

WO WO 0217888 3/2002

* cited by examiner

*Primary Examiner*—David L Sorkin
(74) *Attorney, Agent, or Firm*—Jones, Walker, Waechter, Poitevent, Carrere & Denegre

(57) ABSTRACT

A liquid transport system including a bag adapted to hold fluids, the bag being constructed of a flexible fabric. The bag has a top portion, a bottom portion and a sidewall portion forming an interior and exterior. The system includes a discharge port, a fill port and a series of injector ports on the bag providing fluid access to the interior of the bag from the exterior, where each of the ports are sealingly closable. The discharge port and the fill port are adapted to allow product to flow into and out of the bag, and the injector ports are adapted to accommodate an injector probe.

19 Claims, 6 Drawing Sheets

METHOD OF MIXING BY GAS INJECTION

This is a continuation application claiming the benefit of and priority to PCT/US2005/021567 filed on Jun. 17, 2005 and U.S. Provisional Patent Application Ser. No. 60/616,691 filed on Oct. 7, 2004 which is incorporated by reference herein in its entirety.

FIELD OF INVENTION

This invention relates to bulk fluid container bags, and methods to empty filled bulk fluid container bags.

BACKGROUND OF INVENTION

Many fluids are transported in bulk containers, such as ISO tanks and shipping containers, railcar containers, 55 gallon drums and other bulk containers. Highly vicious fluids and fluids high in solids content present particular transportation problems, such as ease of discharge of a filled container.

Examples of high solids content fluids include pepper mash, fruit pulps, grape mash/musk, drilling muds, clay slurries, fish slurries, tomato products, inks, and paints. During transportation, a high solids content fluid can separate into a fluid portion and a solids portion. Upon arrival at the discharge location, the solids separation must be addressed. If the solids portion is dense, the solids will settle to the bottom of the container, requiring removal of the fluids from the top portion of the container and solids removal later. If the solids portion is light, the solids will float to the top and create a solids cap. While the liquid portion is easily discharged from the bottom of the container, the solids cap will remain and must be physically unloaded later. Unloading of the solids can be labor intensive, such as physically breaking up and shoveling the solids cap or solids bottom. To assist in unloading containers filled with high solids content, mechanical agitation has been utilized, such as by placing rotors, vanes or other types of mechanical agitators in the transport tank, or even rotating the entire container (see U.S. Pat. No. 3,132,846, incorporated herein by reference).

Air injection has also been a method of mixing (see U.S. Pat. No. 4,595,296 to Parks, incorporated herein by reference). In the Parks patent, a fluid filled tank has a gas injector (or injectors) fixed to the bottom of the tank connected to a distribution manifold within the tank. The injectors are attached to a source of suitable gas (air, nitrogen or other inert gas), and the gas pulsed into the injectors assist in fluidizing and homogenizing the liquid/solids stored in the tank. The gas injector generally includes a feed line and an accumulator plate positioned at the exit of the feed pipe to assist in shaping the released bubble shape.

Examples of highly vicious fluids include oils/lubricants, syrups, and resins. These types of fluids present discharge problems due to the inability of these fluids to easily flow, resulting in long discharge times. Discharge times can be decreased by heating the fluid, thereby lowering the viscosity and increasing the fluid flows. Generally, either the bottom of the container or the entire container will be heated. However, heat transport in a viscous fluid can be slow and inefficient, and hence, smaller containers, such as a 300 gallon container, are used to reduce the fluid volume to be heated. Even with these smaller containers, heat times and discharge times can still be excessive.

In certain circumstances, it is desirable to transport fluids in flexible bags in a fixed wall container. A disposable bag prevents damage/contamination to the transport container from the fluid and eliminates the need to clean the container after each use. For instance, transport bags are used to reduce the potential for tank contamination of the product when the transported fluid is food stuffs or food grade materials. In these instances, a transport bag can be constructed of food grade plastics and if needed, can be pre-sterilized prior to use. Additionally, transport bags can be used when transporting hazardous materials, thereby preventing contamination of the tank by the fluid. Bag transport of high solids fluids or vicious fluids, however, presents problems, as prior art mechanical agitation or air injection is generally not feasible due to the inability to position the agitation device into the interior of the bag.

SUMMARY OF INVENTION

A liquid transport system includes a bag adapted to hold fluids, the bag being constructed of a flexible fabric. The bag has a top portion, a bottom portion and a sidewall portion forming an interior and exterior. The system includes a discharge port, a fill port and a series of injector ports on the bag providing fluid access to the interior of the bag from the exterior, where each of the ports are sealingly closable. The discharge port and the fill port are adapted to allow product to flow into and out of the bag, and the injector ports are adapted to accommodate an injector probe. The system includes injector probes and an air injector controller to control the timing/sequence and duration of the injected sequence.

OBJECTS OF INVENTION

It is an object of the invention to provide a mixing system for transport containers that allows mixing internal to the container without a mechanical agitator.

It is an object of the system to provide a disposal bag for use in transport containers that provides a liner or bag and a means of mixing within the liner or bag.

It is an object of the invention to provide for transporting and discharging high solids content and high viscosity fluids.

It is an object of the system to provide a system for mixing with injected air within a mixing bag.

DETAILED DESCRIPTION OF THE PREFERRED EMBODIMENT

Figure 1:
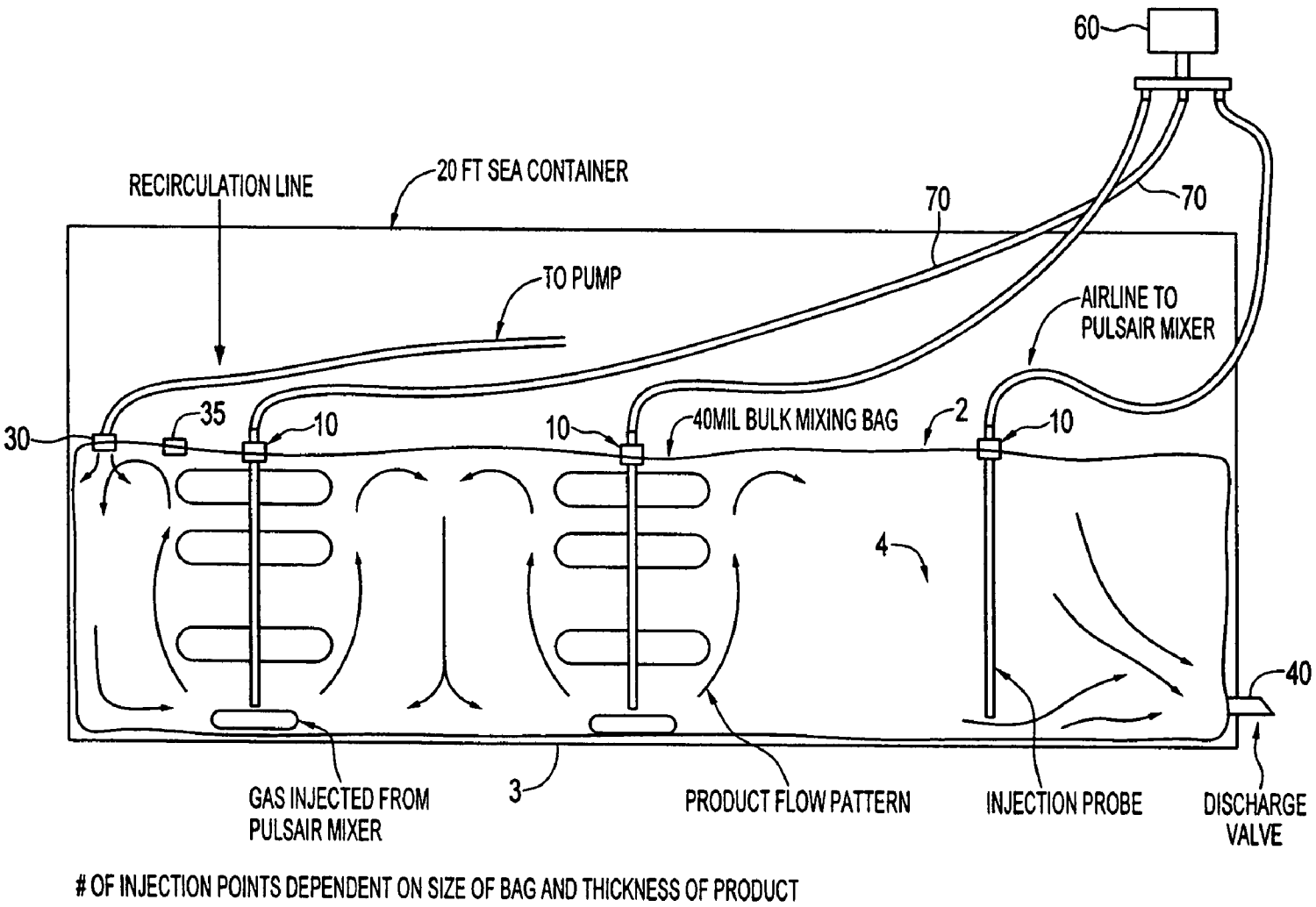
FIG. 1 is a side view schematic of a transport bag utilizing air injection.

Shown in FIG. 1 is a bag 1. Bag 1 is not self supporting and requires a transport container or transport structure for support when filled. Bag 1 is constructed of liquid impervious fabric, such as a suitable plastic or an elastomer, and should be thick enough to stand the rigors of transport and resist inadvertent puncture. For transport of pepper mash (up to 80% solids), a 40 mil bag manufactured of polyethylene has been found suitable. Bag size can vary depending on the transport support structure that will be used to transport the filled bag.

By transport container is meant a container or frame adapted to hold the appropriate sized bag where the bag is adapted to be transported or shipped, and does not refer to a fixed mixing facility container. A common transport container is an ISO shipping container used in bulk marine transport. ISO shipping containers are manufactured in standard sizes. The standard width of ISO containers is 8 feet, the standard heights are 8 feet 6 inches, and 9 feet 6 inches, and the most common lengths are 20 feet and 40 feet. Less common lengths include 24, 28, 44, 45, 46, 48, 53, and 56 feet.

Bag 1 has a top portion 2, a bottom portion 3, and side walls portion 4. In construction, bag 1 can be a cylinder shaped container manufactured from a blown plastic cylinder with the ends sealed. Alternatively, bag 1 can be manufactured from a single sheet that is rolled into an open cylinder with the seam sealed, and the cylinders ends subsequently closed and sealed, such as by heat welding, solvent welding, or other means known in the art. The bag 1 could also be constructed from multiple sheets welded into a rectangular shape or other shape, but such is not preferred as the additional welds or joints present additional potential leakage points.

Figure 4:
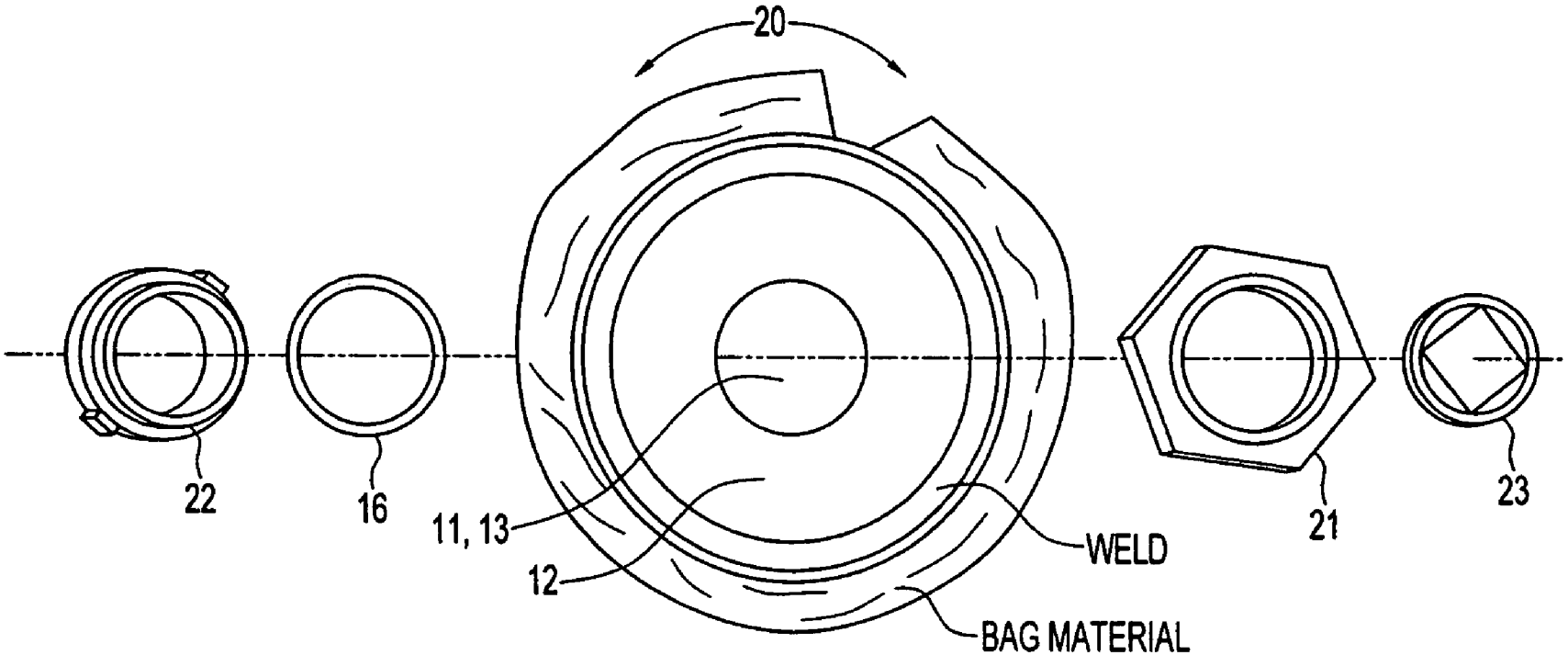
FIG. 4 is an exploded view of an injector fixture.

Located on the top portion of bag 1 is at least one injection port 10. Injection port 10 is a location (port) on the top portion of the bag that can be opened after the bag has been filled and is adapted to sealingly accommodate an air or gas injection means (the injected gas can also vary depending on the application; inert gases, such as nitrogen, could be used when contact with oxygen could promote unwanted bacterial growth). A suitable injection port 10 includes an opening in the bag 11 sealed with a fitting 20. One type of an injection port 10 used is shown in FIG. 4.

This injection port 10 is located at opening 11 in the bag 1. Positioned around the bag opening 11 is a seal member 12. As shown, seal member 12 is a 90 mil circular sheet of polyethylene heat welded to the bag material. Seal member 12 strengthens the area of the bag in surrounding the opening 11. If the bag is sufficiently tear resistant, the seal member 12 can be eliminated. Seal member 12 has an opening 13 which aligns with the bag opening 11. As shown in FIG. 4, openings 11 and 13 are about 2½ inches in diameter. Positioned at the injector port 10 is a fitting 20.

One embodiment of the fitting 20 is two inter-mating parts; here a male and female threaded fitting with a passageway through the fittings, more fully described in U.S. Pat. No. 3,531,142 (incorporated herein by reference). As shown in FIG. 4, fitting 20 has a female member 21 and a male member 22 that are threaded together through the aligned openings 11 and 13, thereby compressing and sealing against the seal member 12. If required, a gasket member 16 could also be used to assist in sealing. As shown, the male member 22 also has internal threads to accommodate a threaded plug 23 in order to close and seal the passageway through the fitting 20. Suitable fittings are made of stainless, polypropylene, PVC or other rigid material, and can be obtained from Banjo Corporation of Crawfordsville, Ind. The threaded plug 23 is a standard 2 inch PVC plug. A threaded cap could be used to seal the passageway if the fitting were designed to accommodate a cap.

Other types of fitting connectors could be used in the injector port, such compression or quick connect fittings. Also, instead of a two piece fitting, the fitting could be a one piece closure, designed to mate with a structure molded onto the seal member 12 (such as an upstanding treaded cylinder molded onto the seal member 12). However, a two piece fitting 20 is preferred for disposable bags, as such a fitting 20 can be removed from the bag to be cleaned and re-used on another bag. With a two piece fitting, the fittings should be installed onto the bag material prior to closing the ends of the bag because the interior is not easily accessed after bag assembly.

The bag 1 can have a series of injection ports 10. Bag 1 also includes a sealable fill port 30, and can include a sealable vent port 35 and a sealable discharge port 40. The fill port 30 is generally positioned on the top portion of the bag 1, such as the center of the top portion, while the discharge port 40 is generally located on the sidewall near the bottom portion of the bag. The discharge port 40 and fill port 30 can be the same port, but this is not preferred when it is desired to re-circulate product prior to or during discharge of product from the bag, as later described. The fill port 30 and discharge port 40 are generally larger than the injection port 10 in order to accommodate product flows. For instance, for a bag designed for a 20 foot ISO container used to transport pepper mash product, a three inch diameter fill and discharge port have been used. If desired, the bag 1 could be equipped with several fill 30 or discharge ports 40. These ports can be constructed similarly to an injection port 10 or with other designs known in the art.

During filling, the fill port 30 is coupled to a product feed line, and product is pumped through the line and into the bag through the fill port 30. Once the bag 1 is suitably full, the product feed line is removed and the fill port 30 is sealingly closed. Feed lines and discharge lines can be attached to the appropriate port with clamps, quick connects, threaded fittings, or other connectors know in the art.

Figure 2:
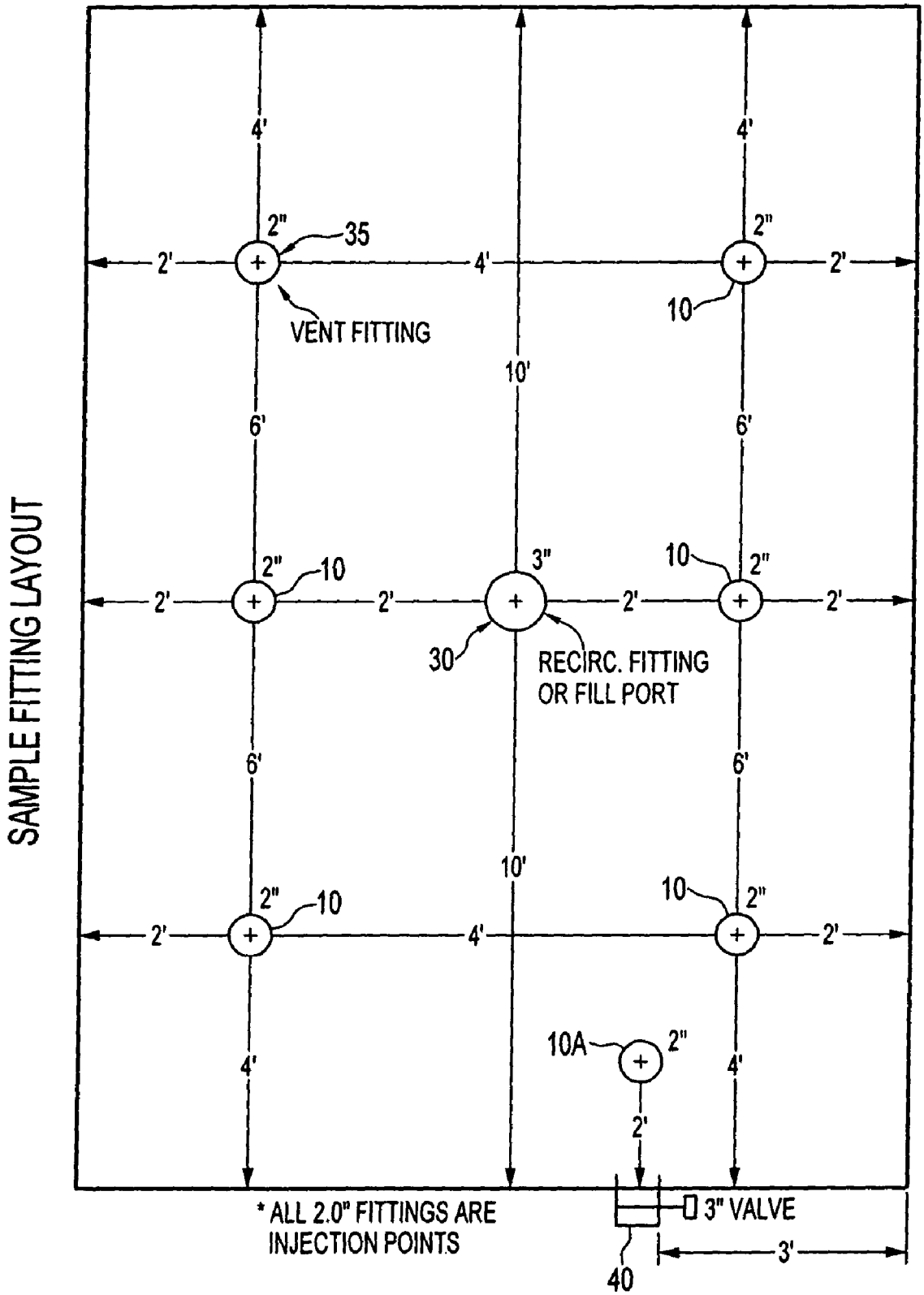
FIG. 2 is a top view schematic of a 20 foot ISO transport bag showing the location of various ports on the bag.

Discharge port 40 is a sealable port on the bag 1 that couples to a discharge line to allow product to be removed from the bag through the discharge port 40. The discharge port 40 may be attached to the discharge line through a valve body or a fitting incorporating a valve body 41, such as a gate valve, to allow controlled release of product. An appropriate valve can be built into the discharge port 40. Additionally, a "T" or "Y" type splitter fitting 43 may be coupled to the discharge port 40, as shown in FIG. 2, to create separate discharge paths and allow for recirculation of a portion (or all) of the discharged product, thereby assisting in mixing. The splitter fitting may be equipped with a suitable valve or valves to control flow and apportion flow through the separate discharge paths. In lieu of a splitter fitting, a second discharge port 40 could be used for product recirculation as later described.

Positioned on the top of the bag 1 is a vent port 35 (an injection port 10 could be used as a vent port 35). Vent port 35 allows the user to bleed off unwanted gas pressure within the bag during filling, discharging or mixing. The vent port 35 may be constructed similarly to an injection port 10 or of other construction known in the art. Vent port 35 may be coupled to a pressure actuated device, such as a spring loaded check valve, to keep the air pressure within the bag 1 at or below a predetermined maximum value.

Injection ports 10 are adapted to accommodate an injector probe 50 at time of product discharge. Injector probes 50 are pipes, tubes or other air passageways with suitable fittings to sealingly couple to the injection port 10. Air injector probes 50 are inserted into the injection ports 10, and connected to a source of suitable gas for injection into the product, generally through an air injection line. The fully installed probe 50 will be almost as long as the bag is high, as the distal end of the probe 50 should be located near the floor of the bag (for pepper mash, 4-12 inched off the floor, with 6 inches being preferred).

Figure 3:
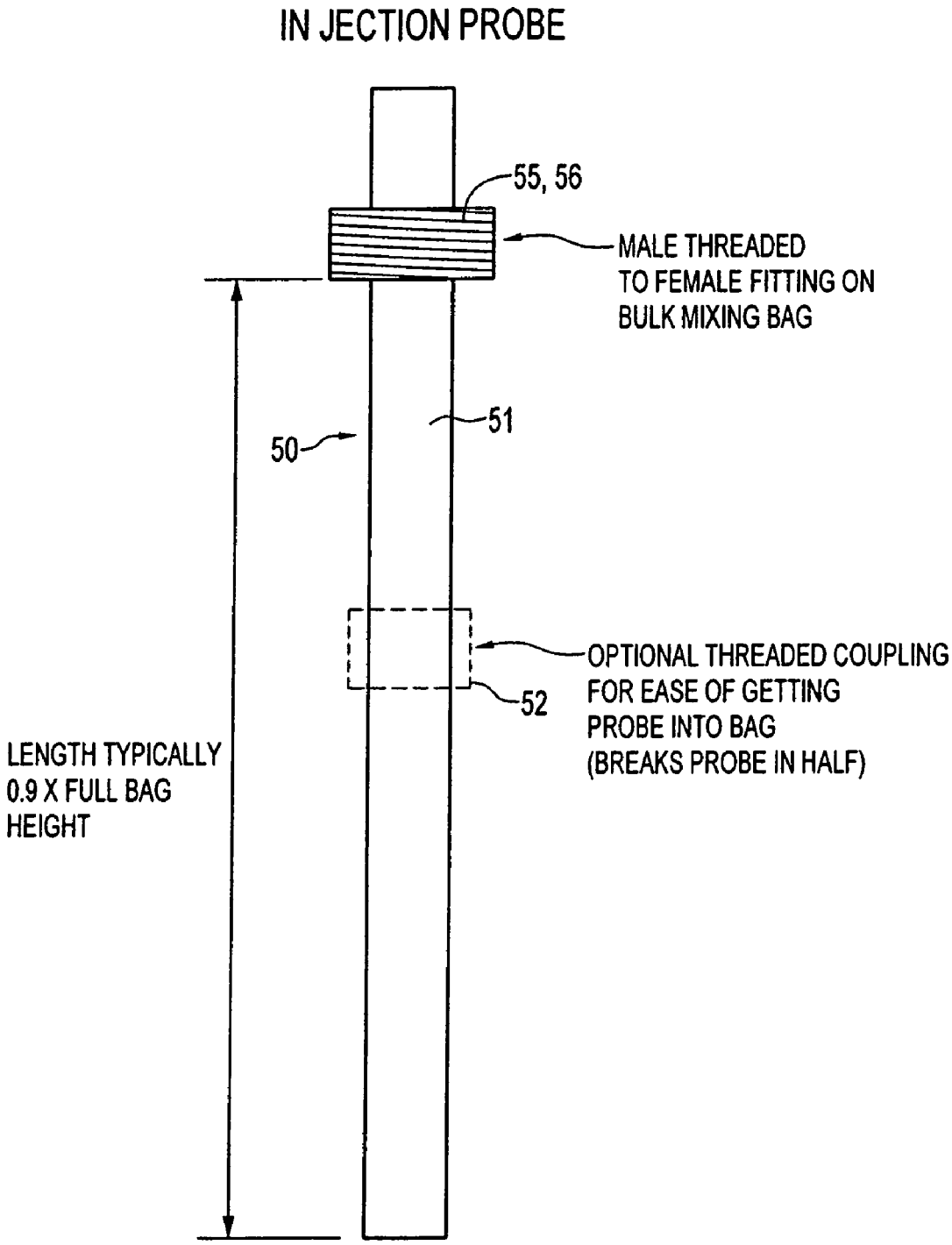
FIG. 3 is a side view schematic of an injector probe.

Installation of a full length injection probe 50 in the closed environment of a transport container containing a filled product bag can be difficult, and hence, the injector probe 50 may be assembled in sections joined with suitable couplings 52, such as a threaded coupling. One embodiment of an injector probe 50 is shown in FIG. 3, showing a pipe 51 constructed of 1 inch PVC, having a male threaded fitting 55 adapted to mate and seal with injector fitting 20 shown in FIG. 4. Fitting 55 could be a female threaded fitting, quick connect, or other connection means. The fitting also keeps the lower end of the injector probe at its desired location by resisting the upward forces caused by air injection through the distal end of the probe 50.

An alternative design for the injector probe 50 is to build the probe into the injector port 10. For instance, a flexible tubing slightly longer than the bag height could be utilized as the injector probe. One end of the flexible tubing would be fixedly connected to the interior floor portion of the bag and the other end of the tube would be connected to a corresponding injection port 10, such as through an injector fitting 20. The flexible tubing may be opened at the bottom, or closed with an opening in the side of the tubing at a desired height above the bottom of the floor portion. In this fashion, the bag 1 could be shipped with injector probes 50 installed, and it is only necessary to connect an air line to the injection ports at the discharge site to initiate mixing.

Use of the Bag

The following operation will be described using a bag 1 having a single injection port, vent port, discharge port and fill port. For small bags, a single injection port may be suitable (for instance, a 300 gallon bag) but for larger bags, multiple injection ports are preferred. It is preferred that an injection port 10 be located near the discharge port 40.

The bag 1 is shipped empty to the fill location. The empty bag is collapsed, and is generally flat or may be folded to create a smaller footprint for shipping. At the fill location, the bag 1 is positioned within the transport container with all ports. The bag 1 is generally still in a collapsed state, but pick up loops may be attached to the exterior of the bag 1 to allow for attachment of the bag 1 onto the transport container. A fill line is attached to the fill port 30, and product then released or pumped through the fill line into the bag 1. The vent port 35 may need to be opened to allow venting of gases in the bag 1 while filling. Alternatively, prior to filling the bag 1 with product, the bag could be "inflated" by attaching a gas injector line to an injection port 10 and filling the bag with a suitable gas to ease the filling process. Once the bag is suitably full, filling stops, the fill line removed, and all ports sealed closed for transport. If the shipping container is a closed container where the top is not removable, it is preferred that either the bag height be less than that of the container height, or alternatively, that the filling stop before the bag is full. Space is required between the container top and bag top to allow an operator to climb into the transport container onto the top portion of the filled bag to access the ports on top of the bag, for instance, to remove and attach hoses, close ports, or other desired actions.

At the discharge facility, the container is opened and an operator climbs onto the bag 1 and opens the fitting 20 at the injection port 10 and inserts an injector probe 50. For a multi-piece injector probe (for instance a two section probe), the operator would insert the bottommost section into the injector probe 50, and the top section would then be threaded onto the bottom section, and the top section also inserted. The threaded coupling on the top section of the injector probe 50 is then treaded onto the fitting 20 at the injection port 10, sealing the probe 50 into the port opening. If the liquid phase of the product is in the top portion of the bag 1, it may be desired to inflate the bag prior to installation of the injector probes to avoid loss of fluid. This may be accomplished by attaching an air line (without a probe) to an injection port 20, injecting air and hence inflating any slack in the bag (keeping the vent port closed). If the solids have formed a cap on top of the liquids, the operator will have to force the probe 50 through the solids layer. To assist, the probe's distal end may be shaped to assist in piercing a solids cap.

Once the probe 50 is inserted, an air line or gas line 70 is attached to the injector probe 50. Each air line is connected to a valve, and the valves are connected to an air distribution manifold, and gas injection is begun. The values are operated by a controller 60 to control the cycling and duration of the air pulses to the injection ports 10. Suitable controllers are available from Pulsair Systems, Inc. in Bellevue Wash. To bleed off excess gas pressure, the vent port 30 is opened. While gas injection can be continuous, it has been found that pulsing gas into the system is generally more efficient. Further, while all injection ports/probes could be pulsed simultaneously (such as by having the air feeder lines tie into a common air distribution line) it is preferred to pulse each probe sequentially. For instance, a preferred pulsing pattern is to pulse from the back of the bag (furthest from the discharge port) to the front of the bag.

Gas is pulsed into the bag through the probe, and enters the product near the bottom of the bag. The rising air mixes the product and will break up the solids layer. After a suitable mixing period, a fairly homogeneous mixture is obtained, and the discharge port 40 can be opened, and product removed. Air injection may continue or cease during product discharge, dependent upon the product's characteristics. For instance, it may be advantageous to continue air injection for product which quickly separates, particularly injecting air near the discharge port 40 to avoid clogging of the discharge port.

Product fluids may also be re-circulated during mixing and/or discharging. Recirculation pumps product about the system to speed the mixing of the product to more rapidly achieve a fairly homogeneous product. Recirculation can be achieved by attaching a fluid recirculation line to a port on the bag. Generally, the recirculation line has one end attached to the discharge port 40, and the other end attached to a fill port 30 or an injector port 20 (henceforth referred to as a recirculation port). The recirculation line may be attached to the discharge port 40 by coupling to one end of a splitter fitting positioned on a discharge port 40. It is preferred that a gate valve or other valve is used to control flows through the two available paths in a splitter fitting. A pump then is actuated to draw product through recirculation system.

Figure 5A:
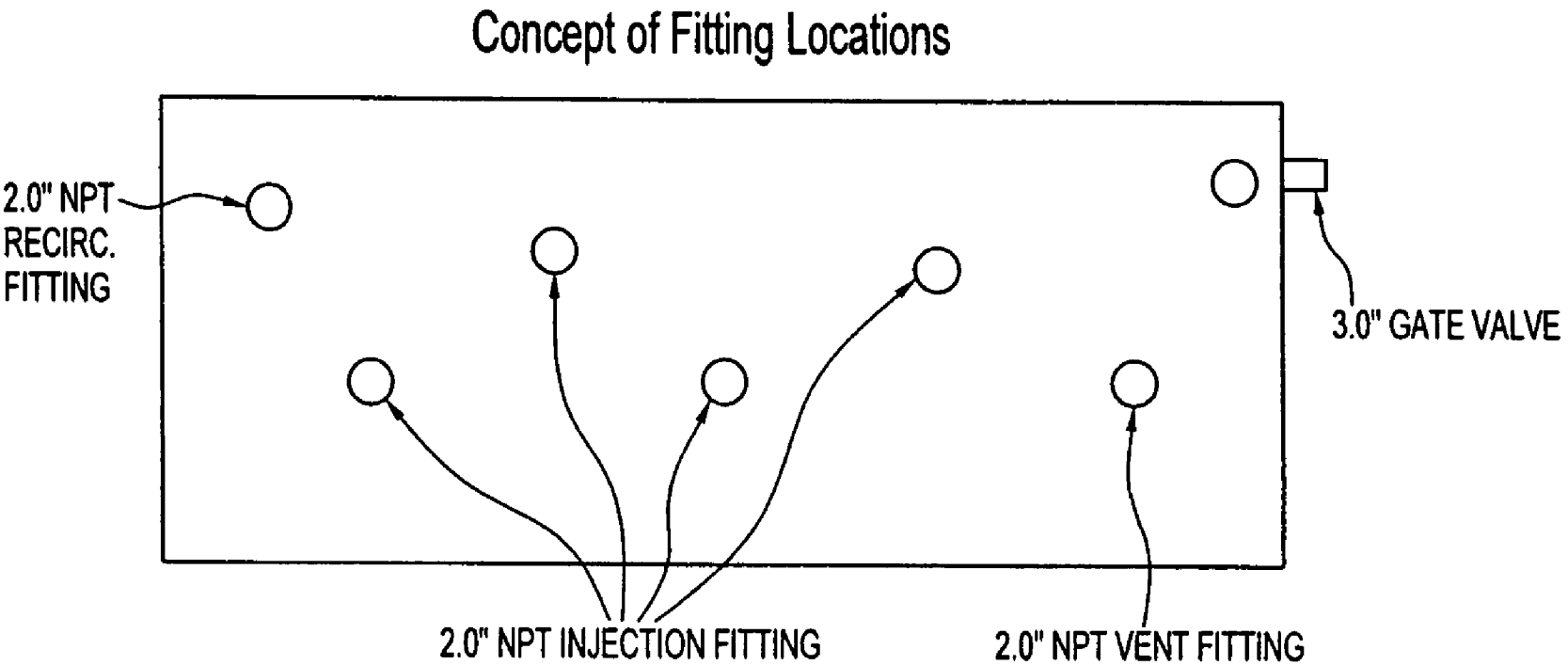
FIG. 5A is a top view schematic of a transport bag showing the locations of various ports.
Figure 5B:
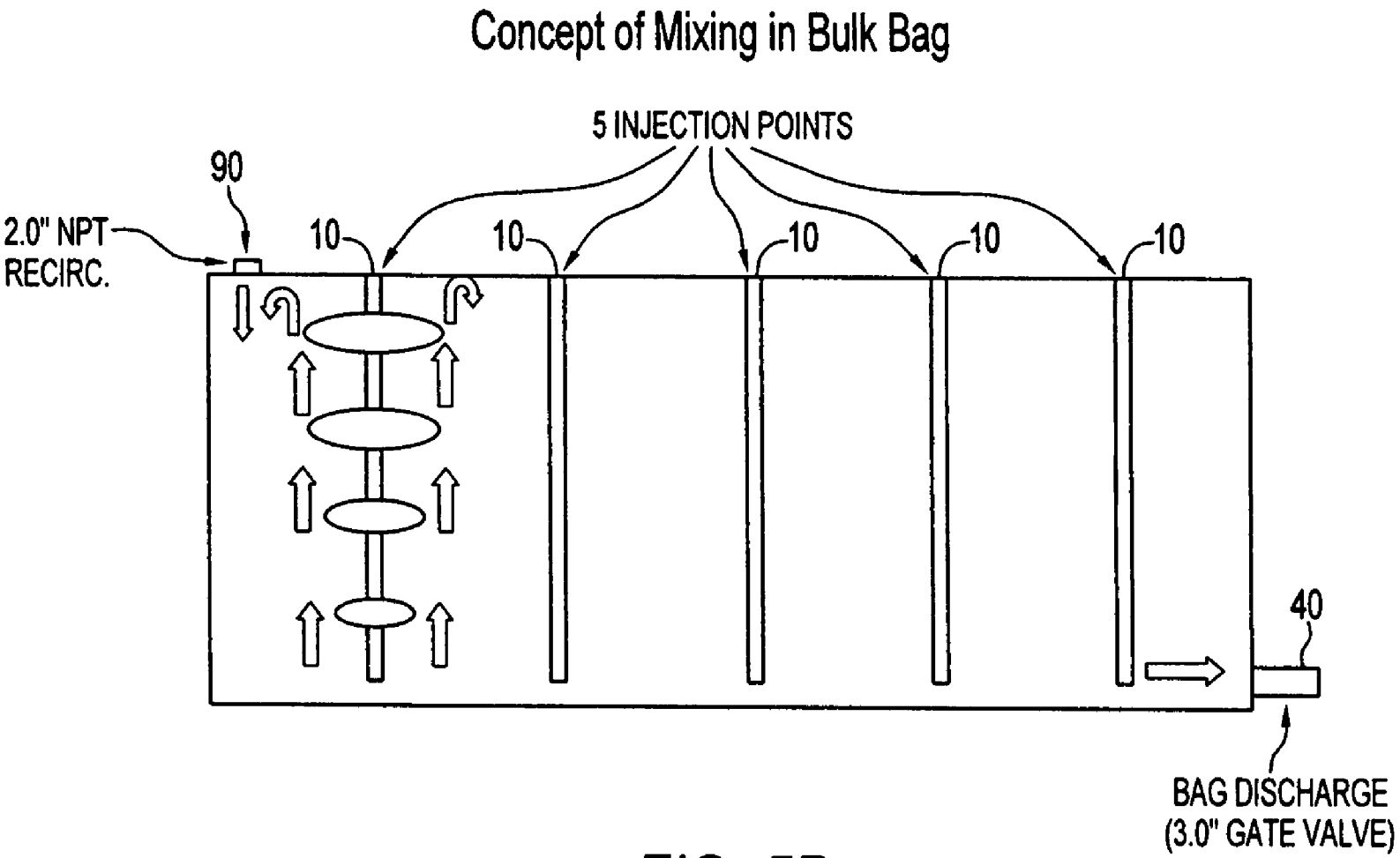
FIG. 5B is a side schematic view of the bag in FIG. 5A depicting the mixing currents generated at one injector location.

The bag 1 shown in FIG. 2 is a 20 foot ISO container bag having six injection ports positioned on the top portion of the bag. Each injection port accommodates a two inch coupling shown in FIG. 4, and available from Banjo Corporation. Notice that one injection port 10A is located so that an injector probe 50 can be placed near the discharge port 40. The discharge port 40 accommodates a three inch opening, as does the fill port 30. The bag 1 shown in FIGS. 5A and 5B are also designed for a 20 foot ISO container bag, having 5 injector ports, a 2 inch recirculation port, and a 2 inch vent port.

The controller 60 can be configured to accommodate a variety of pulse durations and cycle times. For instance, a Pulsair PLC controller system was used for air injection of pepper mash in a 20 foot ISO bag container configured similarly to that shown in FIGS. 5A and 5B. The mash had been stored in the bag for some period, and a solids cap had been formed. The air injection parameters are as follows: air pressure was maintained through a regular to about 80-90 PSI. Each injector was pulsed 55 pulsed per minute (PPM) with a pulse time (dwell time) of 0.5 seconds. Recirculation at 60 gallons per minute was performed simultaneously with air injection. The injectors were pulsed sequentially, in a pattern from the back to the front. After one hour of mixing, the bag was emptied, and product recovery was in excess of 90%.

Injected air creates rising bubbles in the product, inducing a current in the fluid, thereby locally mixing the product. Each injector site will have a local area of influence that is the volume surrounding the injection site affected by the induced current, as depicted in FIG. 5B. It is preferred that the local area of adjacent or neighbor injector points overlap to eliminate dead zones and provide for complete mixing. For pepper mash, a high solids fluid with a solid cap, the area of influence is believed to be a circular area of about 2 to 6 feet diameter when examined near the top of the bag, with 4 feet being preferred. The number and placement of the injection ports 10 will vary depending upon the product characteristics, as well as the injecting parameters. For instance, with a product that has solids which settle, more injectors may be required to ensure adequate coverage at the bottom of the bag. For other types of fluids, the number of injectors, the injection parameters, mixing times, and the need for recirculation, will vary dependent upon the product's desired discharge characteristics and the product's characteristics prior to mixing. It is believed that injection ports separated by distances of 1-10 feet will be sufficient to cover many typical applications.

For mixing vicious fluids, current techniques include heating the product container. Air injection increases the speed of heat transport in the fluid, and hence, decreases the time to raise the temperature of the product to the desired temperature. In fact, if the injected air is heated prior to injection, the current method of directly heating the container can be eliminated.

The bag, injector probes, transport container and air injection system provide a fluid transport system capable of dealing with high solids or high viscosity fluids. Although the present invention has been described in terms of specific embodiments, it is anticipated that alterations and modifications thereof will no doubt become apparent to those skilled in the art which are intended to be included within the scope of the following claims.

We claim:

1. A method of mixing a flowable product within a transport container, wherein said transport container has an interior and a flexible bag positioned in said interior, said bag having a top portion, a bottom portion and a sidewall portion, and an interior, said flexible bag having a discharge port and at least one injection port and also having a vent port, each said ports being sealingly closable; said flowable product positioned in said interior of said bag, the method comprising of the steps of:

(a) providing a gas injection system, said gas injection system having an injection probe and coupling said gas injection system to said flexible bag by inserting said injection probe into the interior of said bag through one of said at least one injection port;

(b) flowing gas through said gas injection system and discharging said gas through said injector probe within said product;

(c) venting gas from said interior of said bag through said vent port;

(d) attaching a discharge line to said discharge port;

(e) discharging product through said discharge port after a suitable mixing period; and (f) withdrawing said injection probe from said interior of said bag.

2. The method of mixing of claim 1, wherein said flexible bag includes a recirculation port and said method further includes the steps of attaching a recirculation line between said discharge port and said recirculation port, and pumping product from said discharge port to said recirculation port.

3. The method of claim 1 wherein said step of flowing gas from said gas injection system further comprises the steps of periodically pulsing gas through said gas injection system through said injectors probe.

4. The method of claim 3 wherein said flexible bag further includes a plurality of injection ports and the gas injection system further comprises a plurality of injector probes and said method further comprises the step of inserting each of said plurality of injector probes into a separate one of said plurality of injection ports and said step of flowing gas further comprises sequentially pulsing gas through said plurality of injection probes, and said step (f) further comprises withdrawing each of said injector probes from the interior of said bag.

5. The method of claim 1 wherein said flowable product is selected from the list of pepper mash, fruit pulps, grape mash/musk, drilling muds, clay slurries, fish slurries, tomato products, ink, and paints.

6. The method of claim 1 wherein said flowable product is selected from the list of oils, lubricants, syrups, and resins.

7. The method of claim 1 wherein said injection port is located on the top portion of said bag.

8. The method of claim 1 wherein said step of discharging product occurs during said step (e).

9. The method of claim 1 wherein said flowing gas is heated.

10. A method of mixing a flowable product within a transport container, wherein said transport container has an interior and a flexible bag positioned in said interior, said bag having a top portion, a bottom portion and a sidewall portion and an interior, said flexible bag having a discharge port and at least one injection port, each of said ports being sealingly closable; said flowable product positioned in said interior of said bag, the method comprising of the steps of:

(a) providing a gas injection system said gas injection system having an injection probe and coupling said gas injection system to said flexible bag by inserting said injection probe into the interior of said bag through one of said at least one injection port;

(b) flowing gas through said gas injection system and discharging said gas within said product through said injector probe;

(c) attaching a discharge line to said discharge port (d) discharging product through said discharge port after a suitable mixing period; and (e) withdrawing said injection probe from said interior of said bag.

11. A method of mixing according to claim 10 further including the step of venting out of the interior of said bag through said injection port.

12. The method of mixing of claim 10, wherein said flexible bag includes a recirculation port and said method further includes the steps of attaching a recirculation line between said discharge port and said recirculation port, and pumping product from said discharge port to said recirculation port.

13. The method of claim 10 wherein said step of flowing gas from said gas injection system further comprises the steps of periodically pulsing gas through said injectors probe.

14. The method of claim 10 wherein said flexible bag further includes a plurality of injection ports and the gas injection system includes a plurality of injector probes coupled to a subset of said injection ports and said method further includes the step of sequentially pulsing gas through said plurality of injection probes.

15. The method of claim 10 wherein said flowable product is selected from the list of pepper mash, fruit pulps, grape mash/musk, drilling muds, clay slurries, fish slurries, tomato products, ink, and paints.

16. The method of claim 10 wherein said flowable product is selected from the list of oils, lubricants, syrups, and resins.

17. The method of claim 10 wherein said injection ports is located on the top portion of said bag.

18. The method of claim 10 wherein said step of discharging product occurs during said step of mixing product.

19. A method of mixing a high solids content fluid product or high viscosity fluid product within a transport container, wherein said transport container has an interior and a flexible bag positioned in said interior, said bag having a top portion, a bottom portion and a sidewall portion defining a bag interior, said flexible bag having a discharge port and a plurality of injection ports, each injection port having an injector probe coupled to said injection port, each said port being sealingly closable; the method consisting of the steps of:

(a) providing a gas injection system and coupling said gas injection system to said injector ports;

(b) mixing said product for a period of time by flowing gas through said gas injection system and discharging said gas through said gas injection system within said product;

(c) venting excess gas from said interior of said bag;

(d) attaching a discharge line to said discharge port; and (e) discharging product through said discharge port after a suitable mixing period.

* * * * *